US009666137B2

(12) United States Patent
Barnhoefer et al.

(10) Patent No.: US 9,666,137 B2
(45) Date of Patent: May 30, 2017

(54) OLED DRIVING TECHNIQUE

(75) Inventors: Ulrich T. Barnhoefer, Cupertino, CA (US); Yongman Lee, Pleasanton, CA (US)

(73) Assignee: APPLE INC., Cupertino, CA (US)

( * ) Notice: Subject to any disclaimer, the term of this patent is extended or adjusted under 35 U.S.C. 154(b) by 1740 days.

(21) Appl. No.: 12/911,513

(22) Filed: Oct. 25, 2010

(65) Prior Publication Data

US 2012/0098870 A1 Apr. 26, 2012

(51) Int. Cl.

| | |
|---|---|
| ***G09G 3/32*** | (2016.01) |
| ***G09G 3/3275*** | (2016.01) |
| *G09G 3/20* | (2006.01) |

(52) U.S. Cl.

CPC ..... *G09G 3/3275* (2013.01); *G09G 3/2044* (2013.01); *G09G 2310/027* (2013.01); *G09G 2320/0276* (2013.01); *G09G 2320/0626* (2013.01); *G09G 2360/144* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,525,683 | B1 | 2/2003 | Gu | |
| 7,038,402 | B1 | 5/2006 | Adler et al. | |
| 7,590,299 | B2 | 9/2009 | Brown Elliott et al. | |
| 7,961,195 | B1 * | 6/2011 | Rogers et al. | 345/555 |
| 2004/0222986 | A1 * | 11/2004 | Kasai | 345/213 |
| 2005/0007393 | A1 * | 1/2005 | Akai et al. | 345/690 |
| 2005/0031199 | A1 * | 2/2005 | Ben-Chorin et al. | 382/162 |
| 2005/0179623 | A1 | 8/2005 | Negoi | |
| 2008/0088548 | A1 * | 4/2008 | Lee et al. | 345/77 |

FOREIGN PATENT DOCUMENTS

WO 2007072321 A1 6/2007

* cited by examiner

*Primary Examiner* — Van Chow
(74) *Attorney, Agent, or Firm* — Fletcher Yoder PC

(57) ABSTRACT

Systems, methods, and devices for efficient brightness control for an organic light emitting diode (OLED) display are provided. In one embodiment, such a method may include receiving image data into a data driver of an organic light emitting diode display and transforming the image data into a logarithmic domain. A dimming control value may be subtracted from this log-encoded image data. The resulting log-encoded dimmed image data may represent a darker version of the originally received image data. Thereafter, a pixel of the organic light emitting diode display may be driven based at least in part on the dimmed image data.

18 Claims, 5 Drawing Sheets

OLED DRIVING TECHNIQUE

BACKGROUND

The present disclosure relates generally to electronic display brightness control and, more particularly, to brightness control for an organic light emitting diode (OLED) display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Flat panel displays, such as liquid crystal displays (LCDs) organic light emitting diode (OLED) displays, are commonly used in a wide variety of electronic devices, including such electronic devices as televisions, computers, and handheld devices (e.g., cellular telephones, audio and video players, gaming systems, and so forth). Such display panels typically provide a flat display in a relatively thin package that is suitable for use in a variety of electronic goods. In addition, such devices typically use less power than comparable display technologies, making them suitable for use in battery-powered devices or in other contexts where it is desirable to reduce power usage.

Electronic displays are not always used at a full brightness setting, but rather may operate at variable brightness levels. For example, since LCDs are backlit, brightness may be adjusted by increasing or decreasing an amount of light emitted by a backlight. The amount of light emitted by the backlight corresponds to the amount of light emitted through each of pixel of the LCD. On the other hand, OLED displays do not rely on a backlight, but rather each OLED may emit light individually. Thus, the brightness of an OLED display may be varied by changing the power supplied to each OLED.

While increasing or decreasing the amount of power may increase or decrease the amount of light emitted by each OLED, the precise amount of light emitted by each OLED may vary according to a nonlinear function. As such, many techniques for adjusting the brightness of OLED screens have conventionally involved performing complex calculations on image data to ensure that when a brightness-adjusted image is displayed on the OLED display, each pixel displays a proper color and brightness. For example, a nonlinear transfer function may be applied to framebuffer-encoded image data and a dimming value divided from the image data. This dimmed image data then may be converted to an analog OLED pixel brightness control signal that is used by the OLED display to output light from OLED pixels. These conventional techniques may consume excessive system resources and/or may be incompatible with existing LCD brightness control mechanisms.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Systems, methods, and devices for efficient brightness control for an organic light emitting diode (OLED) display are provided. In one embodiment, such a method may include receiving image data into a data driver of an organic light emitting diode display and transforming the image data into a logarithmic domain. A dimming control value may be subtracted from this log-encoded image data. The resulting log-encoded dimmed image data may represent a darker version of the originally received image data. Thereafter, a pixel of the organic light emitting diode display may be driven based at least in part on the dimmed image data.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
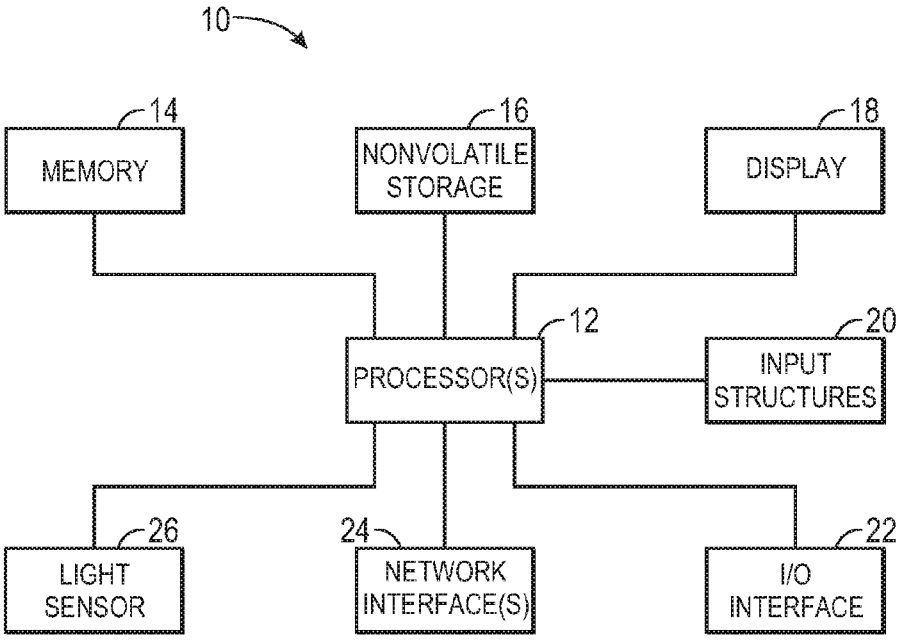
FIG. 1 is a block diagram of an electronic device capable of performing the techniques disclosed herein, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments relate to techniques for efficiently controlling the brightness of an organic light emitting diode (OLED) display. Since the amount of light output by an OLED pixel of an OLED display varies nonlinearly with the amount of power supplied to OLED pixel, increasing or decreasing the brightness of an OLED display cannot simply involve linearly increasing or decreasing the power supplied to these pixels. Embodiments of the present disclosure may avoid such distortion while retaining a relatively simplified manner of brightness control. Specifically, image data may be converted in the data driver integrated circuit (IC) from a framebuffer encoding (e.g., a gamma-corrected color space such as sRGB) to a logarithmic value (i.e., from an initial encoding domain to a logarithmic domain). As used herein, the terms "framebuffer encoding," "framebuffer-encoded," and the like refer to any suitable encoding of image data that may appear in a framebuffer. For example, the framebuffer encoding may include linear, non-gamma-corrected image data, such as may be obtained directly from an image capture device, or may include gamma-corrected image data, such as image data encoded in the sRGB color space. Image data in such a framebuffer encoding may be said to be in a framebuffer-encoded domain or, in corresponding situations, a linear domain or a gamma-corrected domain.

From this logarithmic value, a digital dimming control value may be subtracted rather than divided. This dimmed logarithmic image data then may be converted directly to an analog OLED pixel brightness control signal, without first being converted to a linear digital value, via a digital-to-analog converter (DAC) programmed to convert the logarithmic digital image data to the OLED pixel brightness control signal (i.e., from the logarithmic domain to an OLED pixel control domain). As used herein, the term "OLED pixel brightness control signal" and the like refer to a value that may be interpreted by an OLED display panel to cause an OLED pixel to emit a certain amount of photons. Such an OLED pixel brightness control signal may be said to be in a OLED pixel brightness control domain.

Logarithmically encoding the image data may enable both simplified dimming and digital-to-analog conversion with fewer bits. As mentioned above, dimming the image data may involve simply subtracting, rather than dividing, a dimming value. Additionally, logarithmically encoding image data may encode more information using fewer bits. For example, 8-bit image data may be logarithmically encoded using 7 bits. To account for losses in precision that could be brought about by subtracting the dimming value, 4 additional bits may be added for a total of 11 real bits. After applying certain image refinement techniques such as system correction and/or dithering, the resulting log-encoded image data may hold approximately 9 real bits and 2 virtual bits, for a total effective number of 11 bits. It should be appreciated that this example involving 8 bit image data logarithmically encoded to 7 bits, discussed in greater detail below, is intended only as one possible application of the techniques disclosed herein. Indeed, image data of any suitable data size, which may incorporate any suitable number of additional precision bits, may be used with the present techniques.

With the foregoing in mind, FIG. 1 represents a block diagram of an electronic device 10 employing an organic light emitting diode (OLED) display 18 employing the improved brightness controls disclosed herein. Among other things, the electronic device 10 may include processor(s) 12, memory 14, nonvolatile storage 16, the display 18, input structures 20, an input/output (I/O) interface 22, network interface(s) 24, and/or a light sensor 26. In alternative embodiments, the electronic device 10 may include more or fewer components.

In general, the processor(s) 12 may govern the operation of the electronic device 10. In some embodiments, based on instructions loaded into the memory 14 from the nonvolatile storage 16, the processor(s) 12 may respond to user touch gestures input via the display 18. In addition to these instructions, the nonvolatile storage 16 also may store a variety of data. By way of example, the nonvolatile storage 16 may include a hard disk drive and/or solid state storage, such as Flash memory.

The display 18 may be an organic light emitting diode (OLED) display. As mentioned above, the amount of light output by a pixel of an OLED display varies with the power supplied to the OLED. Thus, to dim image data displayed on the display 18, framebuffer-encoded image data (e.g., linear image data or gamma-corrected image data sRGB) may be converted in a data driver integrated circuit (IC) of the display to a logarithmic value, from which a digital dimming control value may be subtracted rather than divided. Additionally, a digital-to-analog converter (DAC) associated with the data driver IC of the display 18 may be programmed to convert the logarithmic digital image data to an OLED pixel control value analog value, avoiding an additional linearization step.

The display 18 also may represent one of the input structures 20. Other input structures 20 may include, for example, keys, buttons, and/or switches. The I/O ports 22 of the electronic device 10 may enable the electronic device 10 to transmit data to and receive data from other electronic devices 10 and/or various peripheral devices, such as external keyboards or mice. The network interface(s) 24 may enable personal area network (PAN) integration (e.g., Bluetooth), local area network (LAN) integration (e.g., Wi-Fi), and/or wide area network (WAN) integration (e.g., 3G).

The light sensor 26 of the electronic device 10 may measure ambient light for advanced brightness control. Specifically, in some embodiments, when the light sensor 26 detects that the amount of light surrounding the electronic device 10 increases or decreases beyond a threshold amount for a threshold amount of time, the brightness of the display 18 may be adjusted up or down by changing a dimming control value. In this way, image data shown on the display 18 may be brighter when the ambience is brighter, and darker when the ambience is darker.

Figure 2:
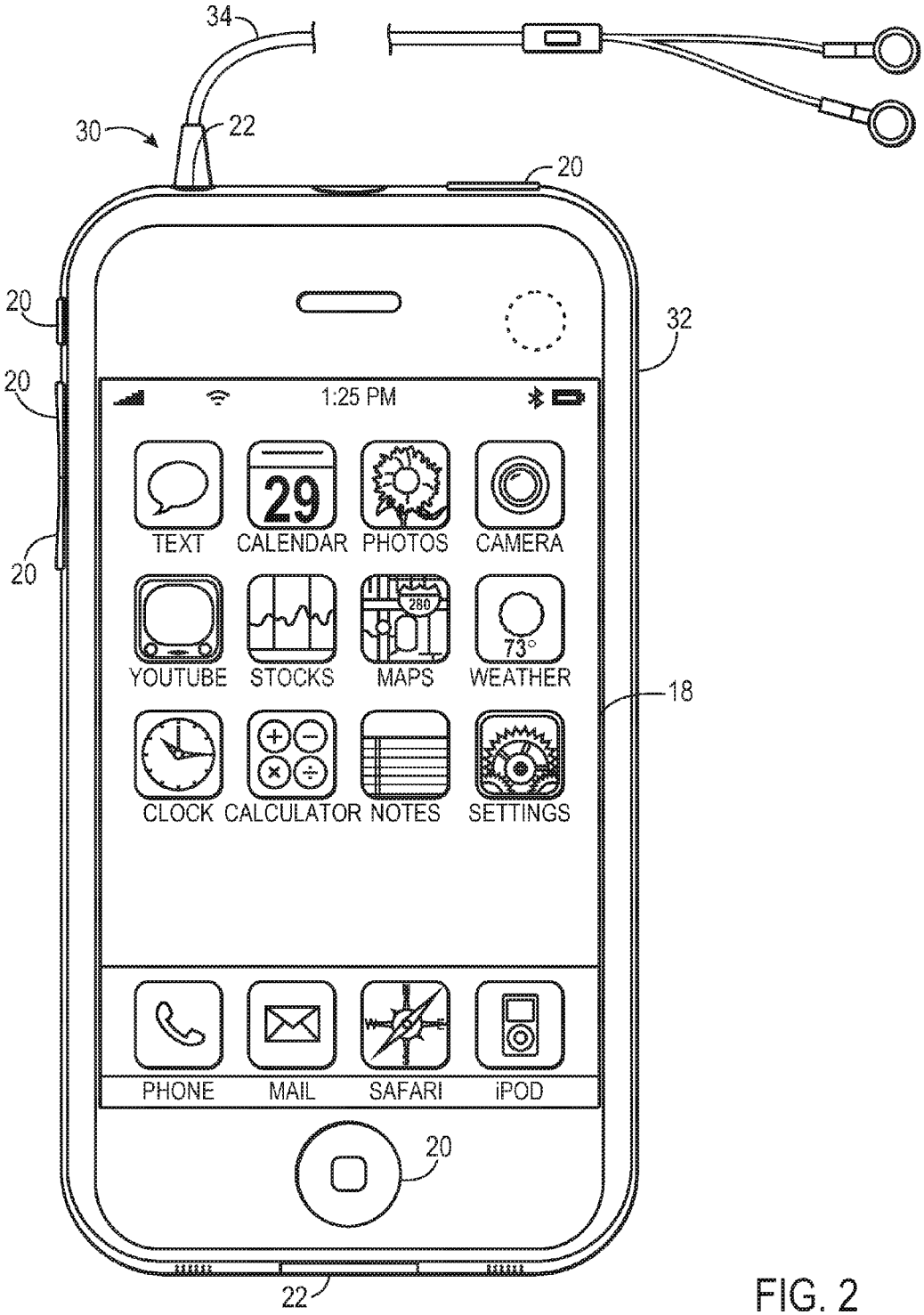
FIG. 2 is an embodiment of the electronic device of FIG. 1 in the form of a handheld device, in accordance with an embodiment.
Figure 4:
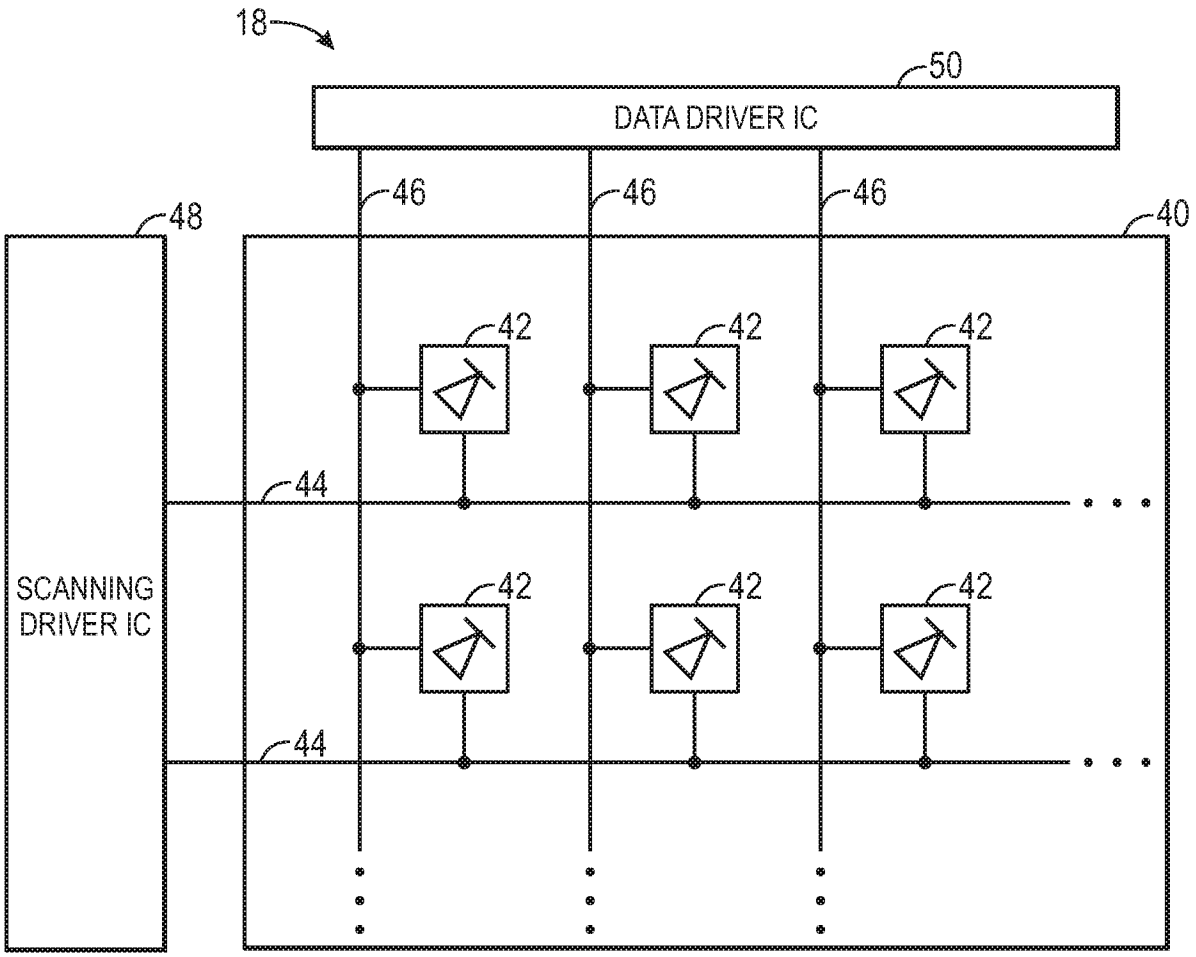
FIG. 4 is a schematic block diagram of an organic light emitting diode (OLED) display of the electronic device of FIG. 1, in accordance with an embodiment.

FIG. 2 illustrates an electronic device 10 in the form of a handheld device 30, here a portable phone. It should be noted that while the handheld device 30 is provided in the context of a portable phone, other types of handheld devices (such as media players for playing music and/or video, personal data organizers, handheld game platforms, and/or combinations of such devices) may also be suitably provided as the electronic device 10. Further, the handheld device 30 may incorporate the functionality of one or more types of devices, such as a media player, a cellular phone, a gaming platform, a personal data organizer, and so forth.

For example, in the depicted embodiment, the handheld device 30 is in the form of a cellular telephone that may provide various additional functionalities (such as the ability to take pictures, record audio and/or video, listen to music, play games, and so forth). As discussed with respect to the general electronic device of FIG. 1, the handheld device 30 may allow a user to connect to and communicate through the Internet or through other networks, such as local or wide area networks. The handheld device 30 also may communicate with other devices using short-range connections, such as Bluetooth and near field communication (NFC). By way of example, the handheld device 30 may be a model of an iPod® or iPhone® available from Apple Inc. of Cupertino, Calif.

The handheld device 30 may include an enclosure 32 or body that protects the interior components from physical damage and shields them from electromagnetic interference. The enclosure 32 may be formed from any suitable material, such as plastic, metal or a composite material, and may allow certain frequencies of electromagnetic radiation to pass through to wireless communication circuitry within handheld device 30 to facilitate wireless communication. The enclosure 32 may also include user input structures 20 through which a user may interface with the device. Each user input structure 20 may be configured to help control a device function when actuated. For example, in a cellular telephone implementation, one or more input structures 20 may be configured to invoke a "home" screen or menu to be displayed, to toggle between a sleep and a wake mode, to silence a ringer for a cell phone application, to increase or decrease a volume output, and so forth.

The display 18 may display a graphical user interface (GUI) that allows a user to interact with the handheld device 30. Icons of the GUI may be selected via a touch screen included in the display 18, or may be selected by one or more input structures 20, such as a wheel or button. The handheld device 30 also may include various I/O ports 22 that allow connection of the handheld device 30 to external devices. For example, one I/O port 22 may be a port that allows the transmission and reception of data or commands between the handheld device 30 and another electronic device, such as a computer. Such an I/O port 22 may be a proprietary port from Apple Inc. or may be an open standard I/O port. Another I/O port 22 may include a headphone jack to allow a headset 34 to connect to the handheld device 30.

Figure 3:
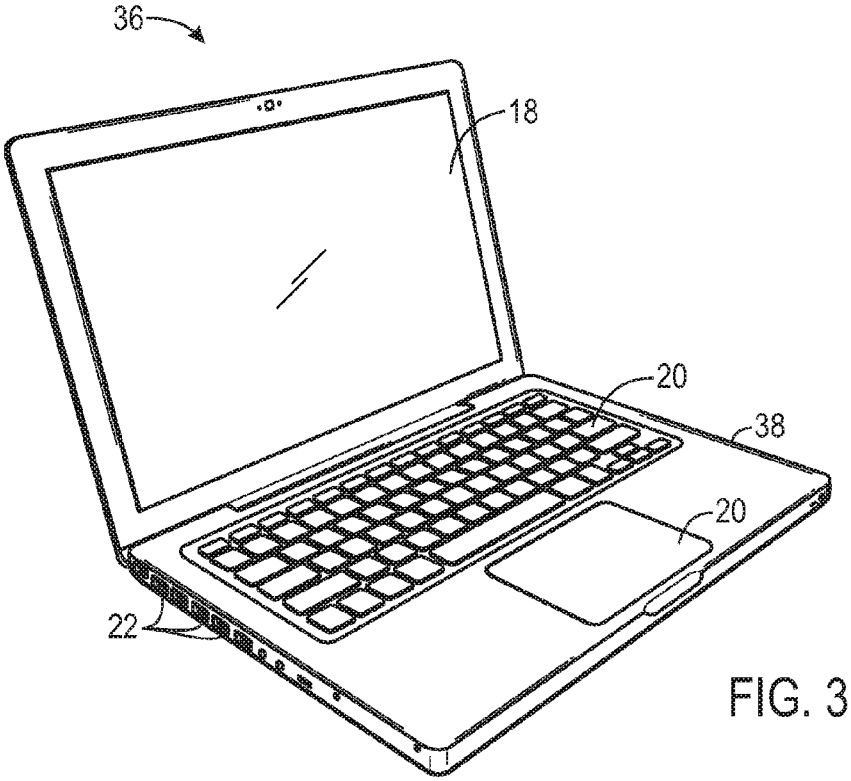
FIG. 3 is an embodiment of the electronic device of FIG. 1 in the form of a computer, in accordance with an embodiment.

In addition to the handheld device 30 of FIG. 2, the electronic device 10 may also take the form of a computer or other type of electronic device. Such a computer may include a computer that is generally portable (such as a laptop, notebook, and/or tablet computer) and/or a computer that is generally used in one place (such as a conventional desktop computer, workstation and/or servers). In certain embodiments, the electronic device 10 in the form of a computer may be a model of a MacBook®, MacBook® Pro, MacBook Air®, iMac®, Mac® mini, or Mac Pro® available from Apple Inc. In another embodiment, the electronic device 10 may be a tablet computing device, such as an iPad® available from Apple Inc. By way of example, a laptop computer 36 is illustrated in FIG. 3 and represents an embodiment of the electronic device 10 in accordance with one embodiment of the present disclosure. Among other things, the computer 36 includes a housing 38, a display 18, input structures 20, and I/O ports 22.

In one embodiment, the input structures 22 (such as a keyboard and/or touchpad) may enable interaction with the computer 36, such as to start, control, or operate a GUI or applications running on the computer 36. For example, a keyboard and/or touchpad may allow a user to navigate a user interface or application interface displayed on the display 18. Also as depicted, the computer 36 may also include various I/O ports 22 to allow connection of additional devices. For example, the computer 36 may include one or more I/O ports 22, such as a USB port or other port, suitable for connecting to another electronic device, a projector, a supplemental display, and so forth. In addition, the computer 36 may include network connectivity, memory, and storage capabilities, as described with respect to FIG. 1.

As noted briefly above, the display 18 represented in the embodiments of FIGS. 1-3 is an organic light emitting diode (OLED) display. As shown, the display 18 may include an OLED panel 40 having unit pixels 42 disposed in a pixel array or matrix. In such an array, each unit pixel 42 may be defined by the intersection of rows and columns, represented here by the illustrated scanning lines 44 and data lines 46, respectively. Although only six unit pixels 42 are shown for purposes of simplicity, it should be understood that in an actual implementation, each data line 46 and scanning line 44 may include hundreds or thousands of such unit pixels 42. Moreover, in some embodiments, three unit pixels 42 of three different colors may be stacked atop each other rather than side-by-side.

As shown in the present embodiment, each unit pixel 42 includes an organic light emitting diode (OLED) capable of emitting light of a particular color. Each unit pixel 42 may be electrically connected to one scanning line 44 and one data line 46. A scanning driver integrated circuit (IC) 48 may control when the pixels 42 become activated and able to receive image data signals. When a signal is provided across a scanning line 44, the unit pixels 42 coupled to the scanning line 44 become active and able to receive an analog pixel brightness control signal from a data line 46. A data driver IC 50 then may provide the pixel brightness control value across the data line 46 that, when received by a unit pixel 42, causes the OLED of the pixel 42 to emit a specific amount of light.

Figure 5:
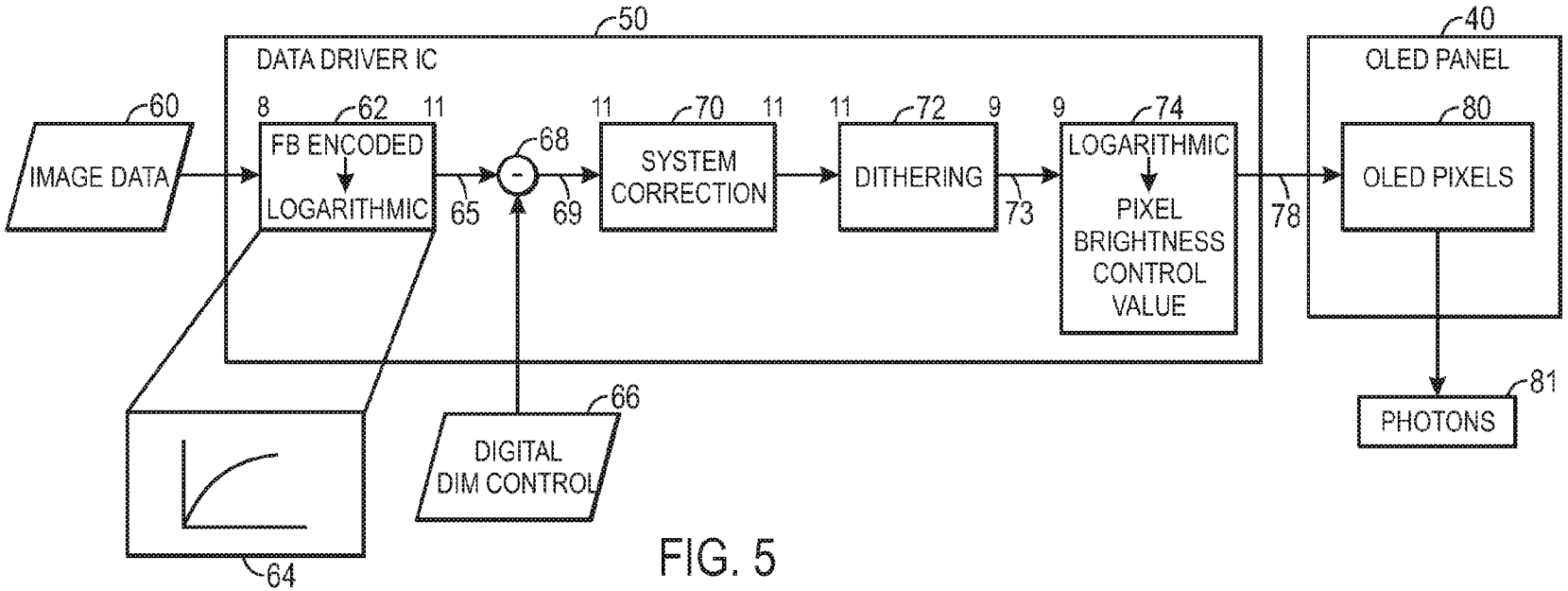
FIG. 5 is a schematic block diagram of a data driver integrated circuit (IC) of the OLED display of FIG. 4, in accordance with an embodiment.

The data driver IC 50 may provide an image data signal that has been dimmed from a maximum brightness level. As shown by FIG. 5, framebuffer-encoded (e.g., sRGB or any other suitable image processing value) image data 60 from a framebuffer of the electronic device 10 may enter the data driver IC 50, which may modify the brightness of the image data and perform various other refinements before outputting an analog pixel brightness control value to the OLED panel 40. The data driver IC 50 may adjust the brightness of the image data 60 after its conversion to a logarithmic encoding, allowing a dimming value to simply be subtracted, rather than divided, to produce dimmed image data.

In particular, a framebuffer-encoded-to-logarithmic block 62 of the data driver IC 50 may apply a framebuffer-encoded-to-logarithmic function 64 to the image data 60 to produce log-encoded image data 65 using, for example, a digital lookup table (LUT). Such a lookup table may be precalculated and may indicate the conversion of each possible value of the image data 60 in the framebuffer-encoded domain to each possible value of the log-encoded image data 65 in the logarithmic domain. In other words, the log-encoded image data 65 output by the framebuffer-encoded-to-logarithmic block 62 may be understood to have been converted from a framebuffer-encoded domain to a logarithmic domain.

As noted above, logarithmically encoding image data may encode more information using fewer bits. For example, the framebuffer-encoded image data 60 may be 8-bit image data that, when logarithmically encoded, takes up only 7 bits. However, to account for losses in precision that could be brought about by subtracting a dimming value, 4 additional bits may be added for a total of 11 bits in the log-encoded image data 65. In other embodiments, more or fewer precision bits may be added to produce the log-encoded image data 65. For example, other embodiments may add no additional bits, or may add 1, 2, 3, 5, 6, or more bits, depending on the level of precision desired. Moreover, the above example involving 8-bit image data logarithmically encoded to 7 bits, discussed in greater detail below, is intended only as one possible application of the techniques disclosed herein. Indeed, image data of any suitable data size, which may incorporate any suitable number of additional precision bits, may be used with the present techniques. Regardless of the size of the framebuffer-encoded image data 60, when the framebuffer-encoded image data 60 is logarithmically encoded, the log-encoded image data 65 may require fewer bits to encode the same data. Thus, even without dimming the log-encoded image data according to the techniques disclosed herein, transforming the log-encoded image data 65 into an analog signal may involve a digital-to-analog converter (DAC) having fewer resistors than otherwise.

Subtracting one logarithmic value from another has the same effect as dividing one linear value by another. Thus, rather than divide a linear dimming control value from a linearized value of the image data 60 to obtain dimmed image data, which could involve complex calculations and/or consume substantial resources, a logarithmic digital dimming control value 66 may be simply subtracted from the log-encoded image data 65 in a subtraction block 68 to obtain log-encoded digitally dimmed image data 69. This log-encoded digitally dimmed image data 69 represents an image signal that, if transformed from the logarithmic domain to the OLED pixel brightness control domain and output to the OLED panel 40, would represent a darker version of the same color as the original input image data 60. The resulting log-encoded digitally dimmed image data 69 may include the same number of bits as the log-encoded image data 65, or may include additional bits to offset losses in precision that could be induced by the subtraction block 68.

The logarithmic digital dimming control value 66 may represent a logarithmic encoding of any dimming signal associated with any suitable dimming control system, such as those used for dimming an LCD display. Rather than supply a dimming control value to a backlight control to reduce the amount light output by a backlight, which may not be present in the OLED display 18, such a dimming control value may be converted to a logarithmic value and provided as the digital dimming control value 66. The dimming control value may be converted to a logarithmic value via, for example, a digital lookup table (LUT) in the manner of the framebuffer-encoded-to-logarithmic block 62.

Other processes to refine the log-encoded digitally dimmed image data 69, such as a system correction block 70 or a dithering block 72, may be applied to the log-encoded digitally dimmed image data 69 to produce refined log-encoded image data 73. For example, the system correction block 70 may provide a color correction that may be unique to the OLED panel 40 or to the vendor of the OLED panel 40. This system correction block 70 may neither add nor subtract any bits of the log-encoded digitally dimmed image data 69. The dithering block 72 may, by spatial, temporal, or spatiotemporal dithering, compensate for some of the least significant bits of the image data output by the system correction block 70. For example, in some embodiments, the dithering block 72 may output 9 real bits, down from the 11 bits it received, as the refined log-encoded image data 73. Still, as a result of the dithering provided by the dithering block 72, the refined log-encoded image data 73 may be understood to include 9 real bits and 2 virtual bits, for an effective total number of 11 bits, or a logarithmic value of $2^{11}$.

In some embodiments, this log-encoded image data may be linearized (e.g., applied in an inverse transfer function and converted from a logarithmic value to a linear value) before being converted to an analog voltage in a digital-to-analog converter (DAC). However, doing so would require the DAC to accommodate the additional bits represented by the linearized rather than logarithmic value. Thus, in the embodiment of FIG. 5, a logarithmic-to-OLED-pixel-brightness-control-domain DAC 74 may convert the refined log-encoded image data 73 from the logarithmic domain to the OLED pixel brightness control domain by effectively applying a function to output an OLED pixel brightness control signal 78. The OLED pixel brightness control signal 78 output by the DAC 74 may be approximately equal to the OLED pixel brightness control signal that would be output by a linear DAC that received a linearized value of the refined log-encoded image data 73. When the OLED panel 40 receives the OLED pixel brightness control signal 78 output by the DAC 74, the OLED panel 40 may drive OLED pixels 80 based on the OLED pixel brightness control signal 78. The OLED pixels 80 may output an amount of photons 81 associated with the OLED pixel brightness control signal 78.

In other embodiments, the logarithmic-to-OLED-pixel-brightness-control-domain DAC 74 may be represented by two distinct functional blocks. That is, a first block may digitally convert the refined log-encoded image data 73 into a digital signal in the pixel brightness control domain and a second block may convert this digital signal into an analog signal. In still other embodiments, the OLED panel 40 may be capable of being controlled via a digital signal in the pixel brightness control domain rather than an analog signal.

Figure 6:
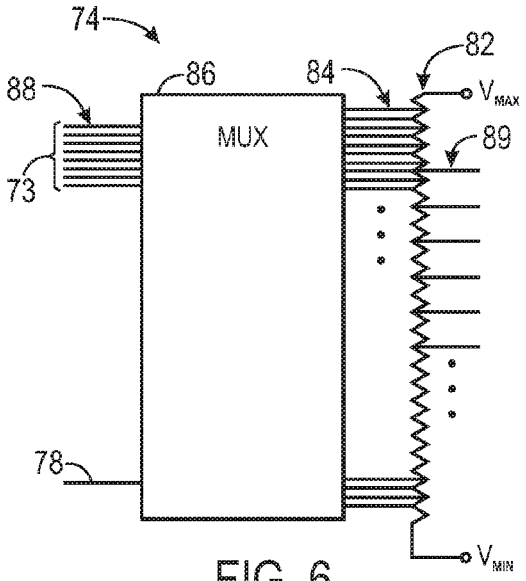
FIG. 6 is a schematic diagram of a digital-to-analog converter (DAC) of the data driver IC of FIG. 5.

In the embodiment illustrated in FIG. 5, the DAC 74 may effectively transform the information encoded in the refined log-encoded dimmed image data 73 from the logarithmic domain to the OLED pixel brightness control domain through a one-time factory programming. One embodiment of the DAC 74 appears in FIG. 6. As illustrated in FIG. 6, the DAC 74 may include a resistor ladder 82 with a series of taps 84 (e.g., 512 taps). The resistor ladder 82 may couple between two voltages (e.g., $V_{MAX}$ and $V_{MIN}$), the taps 84 each providing a slightly different voltage. A multiplexer 86 (or several multiplexers 86) may couple to taps 84 of the resistor ladder 82 based on the bits of a digital input 88, which may receive, for example, a 9-bit refined log-encoded dimmed image data 73 signal. That is, depending on the log-encoded dimmed image data 73 signal provided by the digital input 88, the multiplexer 86 will select one of the taps 84 of the resistor ladder 82, the voltage of which will be output as the OLED pixel brightness control signal 78.

The taps 84 may be approximately equidistant from one another on the resistor ladder 82, but certain refinement taps 89 may "bend" the voltages of the taps 84 to effectively transform the log-encoded dimmed image data 73 signal from the logarithmic domain into the pixel brightness control domain. Any suitable number of refinement taps 89 may be employed. For example, when 512 taps 84 are used, the DAC 74 may include between 5 and 30 refinement taps 89. In one embodiment, 16 refinement taps 89 may be present. The refinement taps 89 may not necessarily be spaced equidistant of one another or equidistant to the taps 84 of the resistor ladder 82. Instead, the placement of the refinement taps 89 and the voltages supplied by the refinement taps 89 may be selected so as to "bend" the voltages of the taps 84 such that when the bits of the digital input 88 correspond to the refined log-encoded dimmed image data 73, the multiplexer 86 outputs the OLED pixel brightness control signal 78 equal to the OLED pixel brightness control signal that would be output by a linear DAC that received a linearized value of the refined log-encoded image data 73. Once the location and/or voltage values of the refinement taps 89 have been programmed once, supplying different values for the digital input 88 (e.g., various values of the refined log-encoded dimmed image data 73) should consistently effectively result in the transformation from the logarithmic domain to the OLED pixel brightness control domain of such different values.

Figure 7:
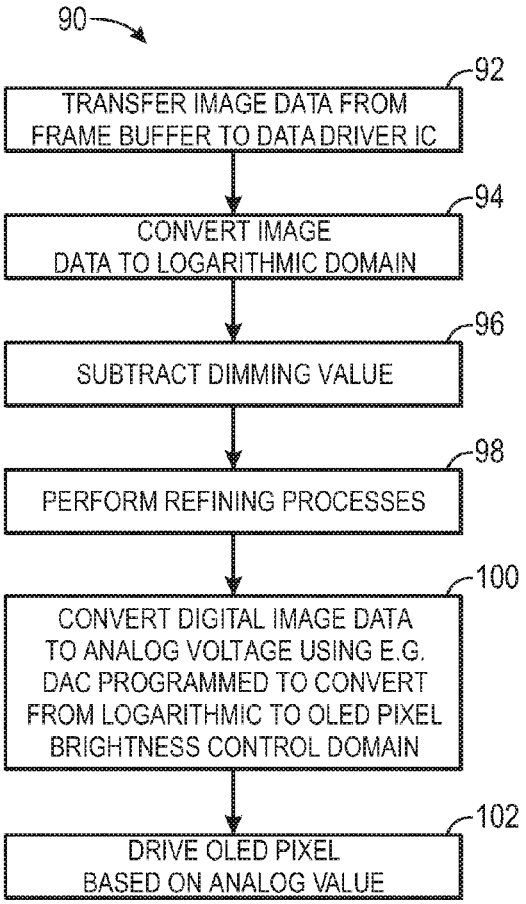
FIG. 7 is a flowchart describing an embodiment of a method for displaying dimmed image data on the OLED display of FIG. 4.

A flowchart 90 of FIG. 7 represents an embodiment of a method for performing brightness control of the OLED display 18. The flowchart 90 may begin when image data 60 in a framebuffer encoding (e.g., sRGB) for a given pixel is provided to the data driver IC 50 (block 92). The data driver IC 50 next may transform the image data from the framebuffer-encoded domain to the logarithmic domain using, for example, a lookup table (LUT) (block 94). To dim the resulting log-encoded image data 65, a dimming control value 66 may be simply subtracted, rather than divided, from this logarithmic value (block 96). Additional processes next may be performed to refine the image data, such as system correction or dithering as shown by blocks 70 and 72 of FIG. 5 (block 98). The resulting refined log-encoded dimmed image data 73 may enter, for example, the logarithmic-to-OLED-pixel-brightness-control-domain DAC 74, which may effectively transform the refined log-encoded dimmed image data 73 from the logarithmic domain to the OLED pixel brightness control domain when the OLED pixel brightness control signal 78 is output (block 100). This OLED pixel brightness control signal 78 may be used to drive the OLED pixels 80 of the OLED panel 40, which may output an amount of photons 81 corresponding to the OLED pixel brightness control signal 78 (block 102).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:
receiving image data into a data driver of an organic light emitting diode display;
transforming the image data into a logarithmic domain to obtain log-encoded image data using the data driver;
performing a subtraction operation comprising subtracting a logarithmic dimming control value from the log-encoded image data to obtain log-encoded dimmed image data using the data driver, wherein the log-encoded dimmed image data represents a darker version of the received image data; and
driving a pixel of the organic light emitting diode display based at least in part on the log-encoded dimmed image data using the data driver.

2. The method of claim 1, wherein the image data received into the data driver comprises data in a gamma-corrected domain and wherein the image data is transformed from the gamma-corrected domain to the logarithmic domain to obtain the log-encoded image data.

3. The method of claim 1, wherein the image data received into the data driver comprises data in a linear domain and wherein the image data is transformed from the linear domain to the logarithmic domain to obtain the log-encoded image data.

4. The method of claim 1, comprising refining the log-encoded dimmed image data by performing a system correction operation or a dithering operation, or a combination thereof, on the log-encoded dimmed image data.

5. The method of claim 1, comprising converting the log-encoded dimmed image data from the logarithmic domain to an organic light emitting diode pixel brightness control domain via a digital-to-analog converter to obtain an analog voltage, wherein the pixel is driven based at least in part on the analog voltage.

6. An organic light emitting diode display comprising:
an organic light emitting diode panel having pixels configured to output light based at least in part on an analog driving signal; and
a data driver integrated circuit configured to provide the analog driving signal to the organic light emitting diode panel, wherein the data driver is configured to receive image data and a logarithmic dimming control value, to transform the image data from a non-logarithmic domain into a logarithmic domain to obtain log-encoded image data, to perform a subtraction operation comprising subtracting the logarithmic dimming control value from the log-encoded image data to obtain log-encoded dimmed image data, and to convert the log-encoded dimmed image data into the analog driving signal.

7. The display of claim 6, wherein the data driver integrated circuit is configured to convert the log-encoded dimmed image data into the analog driving signal via a digital-to-analog converter, wherein the digital-to-analog converter is programmed to transform the log-encoded dimmed image data from the logarithmic domain to an organic light emitting diode pixel brightness control domain.

8. The display of claim 6, wherein the data driver integrated circuit is configured to receive the image data, wherein the image data comprises a first plurality of bits, and to transform the image data from the non-logarithmic domain into the logarithmic domain to obtain the log-encoded image data, wherein the log-encoded image data encodes the same information as the image data using a second plurality of bits, wherein the second plurality of bits is less than the first plurality of bits.

9. The display of claim 8, wherein the log-encoded image data comprises additional bits added to the second plurality of bits to prevent a loss of precision when the logarithmic dimming control value is subtracted from the log-encoded image data.

10. The display of claim 6, wherein the data driver integrated circuit is configured to refine the log-encoded dimmed image data by replacing 2 or 3 real bits with 2 or 3 virtual bits before converting the log-encoded dimmed image data into the analog driving signal.

11. A data driver for an organic light emitting diode display comprising:
circuitry configured to receive image data in a first domain from a framebuffer;
circuitry configured to transform the image data from the first domain to a second domain, wherein the second domain is a logarithmic domain, to obtain log-encoded image data;
circuitry configured to convert the log-encoded image data into log-encoded dimmed image data, wherein the log-encoded dimmed image data comprises a logarithmic representation of a darker version of the image, wherein the circuitry configured to convert the log-encoded image data into the log-encoded dimmed image data comprises circuitry configured to perform a subtraction operation by subtracting a logarithmic dimming control value from the log-encoded image data; and a digital-to-analog converter programmed to transform the log-encoded dimmed image data from the second domain to a third domain to obtain an analog OLED pixel driving signal for driving a pixel of the organic light emitting diode display.

12. The data driver of claim 11, wherein the first domain is a gamma-corrected domain and the third domain is an organic light emitting diode pixel brightness control domain.

13. The data driver of claim 11, wherein the first domain and the third domain are the same.

14. The data driver of claim 11, wherein the digital-to-analog converter comprises a resistor ladder having a plurality of taps and a multiplexer, the plurality of taps providing a respective plurality of voltages, wherein the multiplexer is configured to select from among the plurality of taps based on the log-encoded dimmed image data to obtain the analog OLED pixel driving signal, wherein the plurality of taps is configured to provide the respective plurality of voltages such that the digital-to-analog converter transforms the log-encoded dimmed image data from the second domain to the third domain to obtain the analog OLED pixel driving signal.

15. The data driver of claim 14, wherein a plurality of refinement taps is configured to provide a respective plurality of refinement voltages to the resistor ladder such that the plurality of taps provides the respective plurality of voltages.

16. An electronic device comprising:

memory configured to store image data; and an organic light emitting diode display configured to output light based at least in part on an analog driving signal, wherein the organic light emitting diode display is configured to determine the analog driving signal by receiving the image data from the memory, transforming the image data from a framebuffer-encoded domain into a logarithmic domain to obtain log-encoded image data, operating on the log-encoded image data, and converting the log-encoded image data from the framebuffer-encoded domain to an organic light emitting diode pixel brightness control domain to obtain the analog driving signal, wherein operating on the log-encoded image data comprises performing a subtraction operation comprising subtracting a logarithmic dimming control value from the log-encoded image data such that the resulting log-encoded image data encodes a darker version of the image data stored in the memory without a substantial change in color.

17. The electronic device of claim 16, wherein the image data has 8 bits, the log-encoded image data has 7 bits plus one or more additional precision bits before being operated on by the organic light emitting diode display and 9 real bits and 2 virtual bits after being operated on by the organic light emitting diode display.

18. The electronic device of claim 16, wherein the organic light emitting diode display is configured to convert the log-encoded image data into the analog driving signal via a digital-to-analog converter configured to transform the log-encoded image data to an organic light emitting diode pixel brightness control domain.

* * * * *